US005460193A

United States Patent [19]

Levallois et al.

[11] Patent Number: 5,460,193

[45] Date of Patent: Oct. 24, 1995

[54] METHOD AND DEVICE FOR CLEANING THE WALLS OF A CONTAINER

[75] Inventors: Emile Levallois, Courbevoie; Alain Delmas, Malakoff, both of France

[73] Assignee: Institute Francais du Petrole, Rueil Malmaisson, France

[21] Appl. No.: 167,349

[22] Filed: Dec. 15, 1993

[30] Foreign Application Priority Data

Dec. 15, 1992 [FR] France ..... 92 15111

[51] Int. Cl.[6] ..... B08B 9/08

[52] U.S. Cl. ..... 134/56 R; 134/167 R; 134/181

[58] Field of Search ..... 134/56 R, 57 R, 134/58 R, 167 R, 172, 181, 168 R

[56] References Cited

U.S. PATENT DOCUMENTS

| | | | |
|---|---|---|---|
| 2,005,180 | 6/1935 | Cronin | 134/167 R |
| 3,021,863 | 2/1962 | Low | 134/57 D |
| 3,358,935 | 12/1967 | Andersen | 134/167 R |
| 3,400,727 | 9/1968 | Daum et al. | 134/181 |
| 3,595,256 | 7/1971 | Waltman et al. | 134/167 R |
| 3,895,756 | 7/1975 | Jaeger | 134/181 |
| 4,163,455 | 8/1979 | Herbert et al. | 134/172 |
| 4,986,476 | 1/1991 | Hour | 134/181 |
| 5,107,873 | 4/1992 | Clinger | 134/167 R |

FOREIGN PATENT DOCUMENTS

| | | | |
|---|---|---|---|
| 2621626 | 4/1989 | France . | |
| 975901 | 11/1964 | Germany . | |
| 2557566 | 4/1970 | Germany . | |
| 54-133761 | 10/1979 | Japan | 134/167 R |
| 2152363 | 8/1985 | United Kingdom . | |
| 2177591 | 1/1987 | United Kingdom | 134/167 R |

*Primary Examiner*—Frankie L. Stinson
*Attorney, Agent, or Firm*—Antonelli, Terry, Stout & Kraus

[57] ABSTRACT

Device for cleaning the walls (1, 2) of a tank with a pressurized fluid comprising a rotating stand (3) equipped with at least one pressurized cleaning fluid spray element (5, 6). The spray element (5, 6) may have nozzles (J) and displacement means allowing it to be positioned relative to the walls of the tank to achieve complete cleaning of all the walls of the tank.

Method implemented by the device.

FIG. 1 to be published.

7 Claims, 2 Drawing Sheets

METHOD AND DEVICE FOR CLEANING THE WALLS OF A CONTAINER

The present invention relates to a device for cleaning walls of tanks of all types and sizes for all applications.

The invention applies in particular to petroleum tanks, grain and flour silos, oil tanks, atomization towers, boat and truck tanks, food bins, or in particular cookers.

The devices used to date for cleaning dirty surfaces are, for example, mounted on vehicles and have fixed high-flowrate low cold-water pressure washing lances that have a large number of nozzles to cover a given working area by displacement of the vehicle. The lances can be fixed or movable lances. These devices can include means for heating the cleaning water. In Patent FR-2,621,626, the device includes a supplementary lance for cleaning less easily accessible spots.

Despite all the advantages they present, these devices lack flexibility in adjustment, particularly adaptability to cleaning surfaces of different shapes and different natures. Indeed, depending on the material of the tank to be cleaned, it may be necessary to use a fluid at a higher or lower pressure. Moreover, these devices often have cumbersome designs. The present invention overcomes the aforesaid disadvantages by providing a device and a method allowing jets of fluid to be positioned while adjusting the distance and orientation relative to the walls of the tank to be cleaned and regulating the fluid pressure.

The object of the invention is a device for cleaning the walls or surfaces of a tank, comprising a cleaning fluid reservoir R, the reservoir being connected to means for pressurizing the cleaning fluid, a cleaning tool, and means for channeling the cleaning fluid supplying the cleaning tool. It is characterized by the cleaning tool having, in combination, a rotating stand equipped with at least one device for spraying cleaning fluid under pressure, said device having at least two lances, each of the lances being fitted with at least one nozzle for directing a jet of said cleaning fluid under pressure toward at least one of the walls to be cleaned, whereby the angle between the two lances is chosen as a function of the geometry of the tank to be cleaned, and by comprising means for displacing the spraying element relative to the rotating stand.

The cleaning fluid spray element may have a unit for dispensing cleaning fluid to at least one of the nozzles.

One of the lances may be parallel to one of the walls of the tank if the latter has an elongation direction.

The lances are fitted with position sensors, for example.

The device may also include pneumatic means for moving the nozzles along the lances.

The cleaning fluid dispensing unit may comprise a cylinder, a piston sliding in the cylinder, means for introducing cleaning fluid on one side of the piston and a spring located on the opposite side of the piston, the latter moving under the action of the changes in pressure produced by the cleaning fluid in one direction when the pressure drops and in the opposite direction when the pressure increases.

The piston and the spring may move by stopping and starting of a fluid-pressurization pump comprised in the pressurizing means.

The number of lances can be chosen as a function of the geometry of the tank to be cleaned.

The spray element is for example connected to drive means which move it relative to the walls of the tank to be cleaned.

The invention also relates to a method for cleaning walls of a tank with the aid of a cleaning tool comprising at least one element for spraying a pressurized cleaning fluid toward at least one wall of the tank to be cleaned, characterized by comprising the following stages:

the spray element is positioned relative to the wall of the tank to be cleaned, the cleaning fluid is circulated through the spray element such as to obtain jets directed toward at least one of the walls of the tank, the rotating stand is caused to rotate, and, when the rotating stand has executed a predetermined number of turns, the direction of the cleaning fluid jets is changed, and, this operation is repeated until the walls of the tank to be cleaned are completely swept by the fluid jets.

One may also operate as follows:

the spray element is positioned relative to the wall of the tank to be cleaned, the cleaning fluid is circulated through the spray element such as to obtain fluid jets directed toward at least one of the walls of the tank, the rotating stand is caused to rotate, when the rotating stand has executed essentially one turn, the positions of the nozzles on the spray element are changed, and, when the rotating stand has executed a predetermined number of turns, the direction of the cleaning fluid jets is changed and this operation is repeated until the walls of the tank to be cleaned have been completely swept.

The direction of the cleaning fluid can be changed by causing the pressure of the cleaning fluid to vary.

For example, the fluid pressure is changed by stopping and starting a pressurization pump comprised in the fluid pressurization means.

The stand has a first lance and a second lance, said lances being fitted with nozzles designed to direct a pressurized-fluid jet toward one wall to be cleaned, and the cleaning fluid for example is made to circulate through the nozzles of the first lance, then, after the stand has made a predetermined number of turns, the fluid is circulated through the nozzles of the second lance and the stand is turned by at least one turn such as to sweep the remainder of the wall to be cleaned.

The nozzles of the first lance and/or the second lance can be moved such as to sweep the totality of the walls of the tank to be cleaned.

One of the advantages of the invention is to furnish a device adapted to the shape of the tank to be cleaned.

Another of its advantages results from the mobility of the lances which allows the nozzles to be positioned relative to the wall to be cleaned. It is thus possible to regulate the pressure of the cleaning fluid as a function of the nature of the wall to be cleaned.

Because of the possibility of regulating the fluid pressure, the fluid flowrate is adjusted to the nature of the fluid. By decreasing the pressure, the fluid flowrate is decreased, something which is advantageous when expensive cleaning fluids for example are used.

In the remainder of the specification, "pneumatic circuit" is defined as the set of valves and pipes or hoses in which the pneumatic fluid, air for example, circulates.

The present invention will be better understood by reading the description hereinbelow, which is a nonlimiting example, by reference to the attached drawings, wherein.

Figure 1:
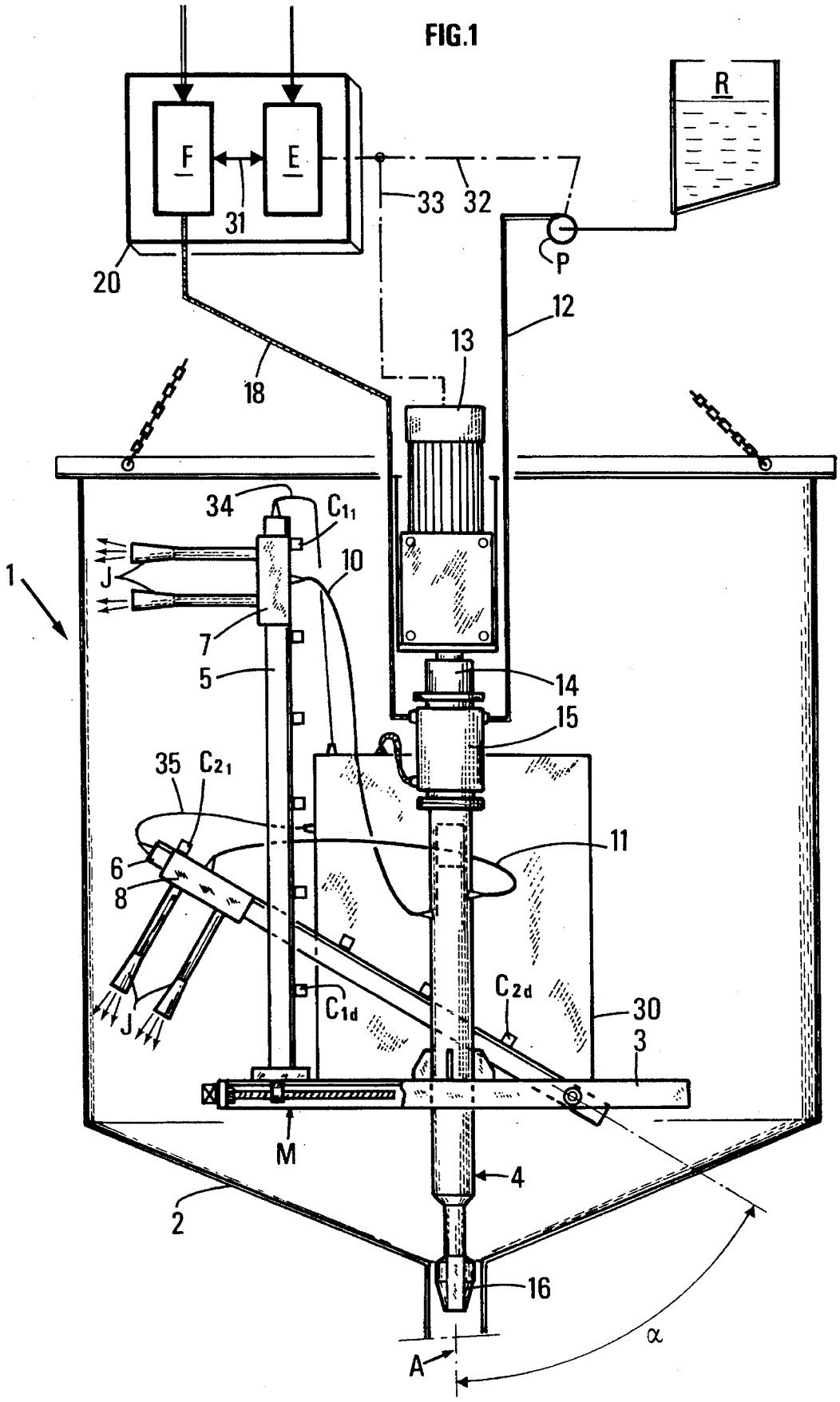
FIG. 1 is a general view of the device according to the invention.

The device described hereinbelow allows a tank or container to be cleaned with the aid of a cleaning fluid sprayed by a cleaning tool and, by adjusting the position of the cleaning fluid jet, for example its distance or orientation relative to the walls of the tank to be cleaned, allows the entire surfaces of the tank walls, namely all the points in the container, to be cleaned. This result is achieved because of the adaptability of the tool according to the invention to the geometry of the tank, and to the nature of the material of which the tank walls are made.

The device also allows the pressure of the cleaning fluid to be adjusted in cases where the walls constituting the tank could be damaged by the force of the jets.

The cleaning tool is positioned in a tank to be cleaned which has for example vertical walls 1 and a cone-shaped wall 2. This tool has a movable stand 3 which is substantially horizontal and integral with a rotating shaft 4 on which at least two lances are positioned, a first guide lance 5 which has a vertical axis and a second guide lance which has an oblique axis 6 making an angle a with the first lance. The value of angle a is determined as a function of the geometry of the tank to be cleaned. Each guide lance 5, 6 is provided with a plurality of position sensors dispensed over its length having the reference $C_{ij}$, whereby $_i$ designates a guide lance and $_j$ designates the position of a sensor on this guide lance. A movable carriage 7, 8 to which one or more injection nozzles J are attached, can slide on each guide lance 5, 6. Pneumatic jacks (not shown) enable the movable carriages to be moved along their respective lances. The position sensors allow the movable carriages or nozzle-bearing carriages 7, 8 to be detected and held in a given position. These movable carriages 7, 8 are connected to a cleaning fluid chamber 9 by hoses 10, 11.

Rotating shaft 4 with axis A is connected by one of its ends to a motor 13 through a coupling 14 and a rotating air-water joint 15 and terminates at its other end in a pivot 16 which fits into a seat in the lower wall of the tank to be cleaned. Fluid chamber 9 and a dispensing unit 17 (FIG. 2) which allows the cleaning fluid to be directed in succession to each guide lance, are provided in this shaft.

A pipe 12 brings the cleaning fluid from an outside reservoir R to chamber 9, which pipe passes through a rotating air-water joint 15. The cleaning fluid then passes from chamber 9 to dispensing unit 17, the latter providing communication between chamber 9 and hoses 10, 11, in order to direct the fluid to one or the other of the guide lances.

The fluid is pressurized by a pump P located on pipe 12.

Heating means, not shown, allow the cleaning fluid to be heated if necessary.

The device has an electropneumatic cabinet 20 that has an electrical block E connected to an electropneumatic block F with power solenoid valves by a link 31.

Electrical block E contains relays (not shown) to dispense control currents to the motor of pump P by a link 31 and to motor 13 which drives the stand, by a link 33.

A conventional outside dispensing unit (not shown) with hydropneumatic fluid, such as air, supplies block P.

A pipe 18 bringing the air from block F passes through rotating joint 15 and terminates in a pneumatic cabinet 30 attached to the stand which has pneumatic logic or an automatic device of a known type, two pneumatically-controlled power valves allowing the air to be directed from the first lance to the second lance, and piloting microvalves for moving the nozzle-bearing carriages. Pneumatic cabinet 30 is linked by hoses 34, 35 with pneumatic jacks located in the lances.

In the embodiment of the invention, the automatic device automatically controls the various operations with the aid of appropriate timers $T_1$, $T_2$, whereby time $T_1$, corresponding to the duration of one turn executed by the rotating stand, serves as a reference for the passage of the nozzle-bearing carriage from one position sensor to another, and time $T_2$ corresponds to the time taken by the nozzle-bearing carriage to travel along one lance from one end to the other; $T_2$ is calculated from the number of sensors located on the lance and the rotational speed of the stand. This time $T_2$ is the time reference which allows dispensing of the cleaning fluid and of the hydropneumatic system fluid to be changed from one lance to another.

In the case of an excessive amount of dirt, or with a view to hygiene, a storage reservoir for additives or detergents is connected to reservoir R of cleaning fluid, for example water, by a pipe, not shown, which has a detergent flow rate adjustment element such as a valve in order to obtain a water-detergent mixture of a given composition.

Vertical-axis lance 5 is movable relative to rotating stand 3 in order to adjust the distance between nozzles J and the wall in order to optimize the action of the jets for a given fluid pressure. The lance is moved on the stand by displacement means M which, for example, have a lance guide rail and a device for holding the lance in a given position.

The positioning freedom of the lances and nozzles which is offered by the device according to the invention allows the pressure of the cleaning fluid to be reduced, which is advantageous in cases where the walls are made of a relatively fragile material which could be damaged by too high a fluid pressure.

The decrease in the cleaning fluid flowrate resulting from the drop in pressure may be useful when expensive fluids are used, as less fluid can be used.

Nozzles J are for example pivoting nozzles which deliver a rotating jet of cleaning fluid which leads to better cleaning of the jet impact surface.

Position sensors $C_{ij}$ of nozzle-bearing carriages 7, 8 are for example magnetic sensors which operate by detecting the presence or absence of an object. The distance between the sensors is at least equal to the cleaning height of the nozzles, which corresponds to a surface swept by the jets of the nozzle on the wall to be cleaned.

Stand drive motor 13 is a variable-frequency electric motor coupled to a gear motor.

Dispensing unit 17 (shown in FIG. 2) has a hollow cylindrical part 19 provided at its upper part with orifices or holes 21 and a hollow piston 22 moving in a cylinder 23. Hollow piston 22 moves in the direction indicated by arrow A (FIG. 3A) under the action of a spring 24 and in the other direction indicated by arrow B under that of the hydraulic pressure producing a stronger action than that of the spring.

Two ramps with specific shapes forming a recess 25 are machined into piston 22. A guide pin 26 attached to cylinder 23 penetrates the recess and locks the piston in a given position either under the action of a spring or under the action of pressure.

Figure 2:
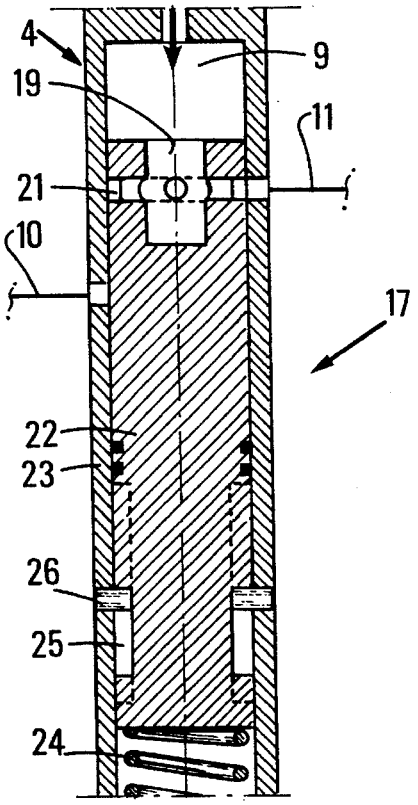
FIG. 2 illustrates the implementation of the cleaning fluid dispensing device.

The change from one position to another is effected as follows: under the action of the hydraulic pressure of the cleaning fluid, the piston is in a given position $P_1$ which corresponds for example to the coincidence of holes 21 with hose 10 dispensing the cleaning fluid to the vertical lance (FIG. 2). When the cleaning fluid pressurization pump is stopped, the spring moves the piston upward (arrow A, FIG. 3A) so as to allow guide pin 26 to come free, so that the piston can move into a resting position 1 in which it remains until the hydraulic pressure exerted by the fluid when the pump is restarted moves the piston downward. Under the effect of the hydraulic pressure, the piston then enters position $P_2$ in the recess and is held in this position by guide pin 26.

In this position, $P_2$, holes 21 coincide with pipe 11 which dispenses the cleaning fluid to oblique lance 26.

The variation in hydraulic fluid pressure thus allows the various positions defined by recess 25 to be assumed.

The operation of such a cleaning tool is for example as follows: the cleaning tool is positioned in the tank to be cleaned, the height, positions, and angle $\alpha$ of the guide lances, or the angles when there are more than two lances, having previously been selected as a function of the geometry of the tank to be cleaned.

Nozzle-bearing carriages 7, 8 are in the positions known as initial positions, for example located at one of the ends of each of guide lances 5, 6 marked by position sensors $C_{11}$ and $C_{21}$.

The automatic device controls electrical cabinet 30 which causes rotating stand 3 to turn and simultaneously controls dispensing of the pressurized fluid to vertical guide lance 5. The jet of pressurized fluid from nozzles J of this lance cleans the wall of the tank along a ring of height ho which depends upon the shape of the jet and the distance between the nozzle and the wall, and with a perimeter equal to that of the perimeter of the tank to be cleaned, because of the rotation of the stand. At the end of a given time $T_1$, the automatic device activates the pneumatic circuit which sends air to the positioning jack of the nozzle-bearing carriage to move the latter along the lance to a neighboring position marked by the next position sensor, located at a distance ho from the preceding sensor. The magnetic sensor detects the nozzle-bearing carriage and locks it into this position. The change from one position to another occurs rapidly and does not require cleaning fluid dispensing to be cut off or rotation of the rotating stand to be stopped. Now that the nozzle-bearing carriage is in its new position, cleaning along a ring with height ho relative to this new position and on the periphery of the tank recommences.

The automatic device manages the movement of nozzle-bearing carriage 7 over the entire length of guide lance 5 and repeats the displacement operations described above for as many times as there are sensors on the lance.

Once nozzle-bearing carriage 7 has reached its final position marked by the last position sensor $C_{1d}$ of guide lance 5, the stand executes a complete rotation controlled by time $T_1$, then the automatic device, where appropriate, controls the change in the dispensing of the cleaning fluid and the air activating the jacks, from the first lance to the second lance, in order to place the second lance in service.

Figure 3B:
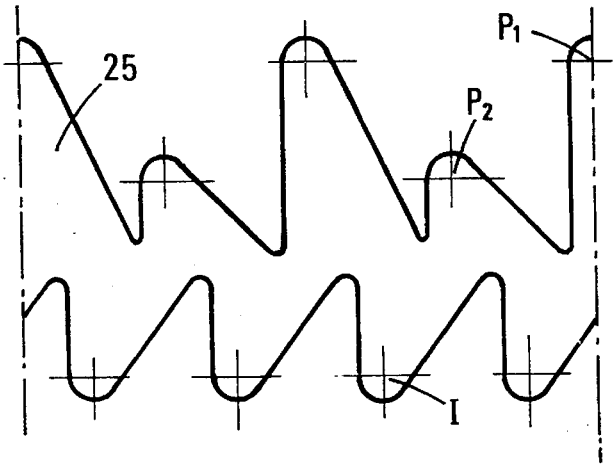
FIGS. 3A and 3B represent details of the total cleaning fluid dispensing, and, FIG. 4 schematically shows one version of the device according to the invention.
Figure 3A:
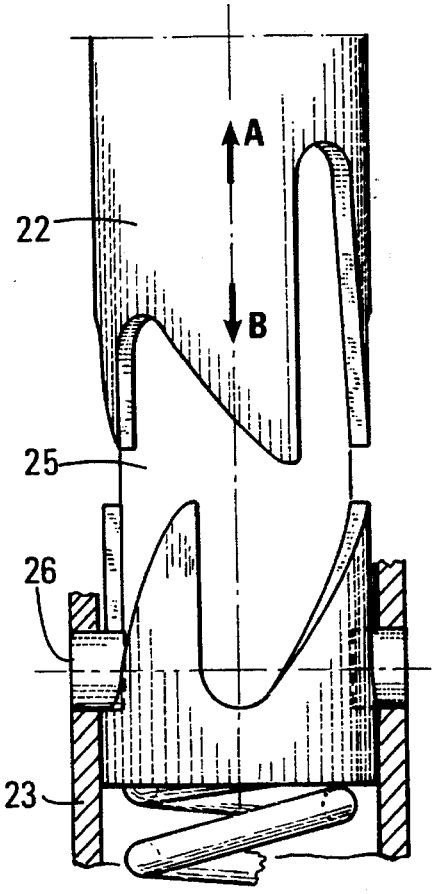

For this purpose, as seen, with reference to FIGS. 2, 3A, and 3B, the automatic device stops the cleaning fluid pressurization pump, which brings about a change in the position of the piston and hence redirection of the cleaning fluid from the nozzles of the vertical guide lance to the nozzles of the oblique guide lance.

During the time the fluid is no longer circulating, the electric cabinet sends a signal to the pneumatic cabinet such as to change the status of the valves to direct air from the first lance to the second lance.

Since these changes are rapid, it is not necessary to turn off the motor driving the rotating stand.

Cleaning of lower wall 2 of the tank by nozzles j of oblique guide lance 6 takes place identically to cleaning of the vertical wall. Cleaning begins in the initial position of the nozzle-bearing carriage marked by sensor $C_{21}$.

When the nozzle-bearing carriage reaches the last position sensor $C_{2d}$ of oblique guide lance 6 and after a complete rotation of the rotating stand, the automatic device stops dispensing of the cleaning fluid, air, and the motor.

The tool described above and its implementation have given excellent results for cleaning walls of a container in which an oil has been heated for 12 hours at over 200° C., using detergent-free pressurized hot water as the cleaning fluid.

The accuracy of the cleaning tool can be improved and its operation optimized. Thus, according to another embodiment, the automatic device is replaced by a signal processing and generating device such as a computer equipped with a data acquisition card and programmed to execute the various operations of the method according to the invention.

In this case, the cleaning tool has position sensors $D_{kl}$ capable of detecting the position of the nozzle-bearing carriage and sending a signal to the computer, such as status sensors. Moreover, rotating stand 3 is equipped with a device able to detect the beginning and the end of one rotation, such as a rotation sensor located on the rotating shaft. The subscripts k and l are used to label a sensor D as a function of the lance and its position on the lance. Position sensors D are of a different nature from position sensors $C_{ij}$ described above but may be placed at identical points on the guide lances, so that FIG. 1 may be used as a guide for the description below.

Such a tool then functions as follows:

the number of sensors $D_{kl}$ with which each guide lance is equipped has been prememorized in the computer together with their initial positions.

The cleaning tool is set in place in the tank, the positions of the nozzle-bearing parts being initialized, for example, at each end of the guide lances, which corresponds to sensors $D_{kl}$.

The microcomputer program causes the cleaning fluid pressurization pump to start at the same time as motor 13 which drives the rotating stand.

The fluid pressure is a parameter predetermined as a function of the distances from the walls of the tank and of the materials of which the tank is composed, and is prememorized.

The rotational speed has been preselected but may be adjusted during the operation of the cleaning tool as a function for example of the height of the nozzle-bearing carriage at a given moment.

The jet of pressurized fluid from the nozzles of the first nozzle-bearing carriage located near sensor $D_{11}$ begins to clean the tank as indicated above, whereby the subscript $_{11}$ corresponds to the first sensor of the first lance activated.

Movement of the nozzle-carrying carriage from one sensor to another is controlled by the signal from the rotation sensor which alerts the microcomputer when the rotation is at an end. On reception of the end-of-rotation signal, the microcomputer sends a signal to the pneumatic circuit which commands movement of the piston of the jack causing the nozzle-carrying carriage to move to the following position sensor.

When the nozzle-carrying carriage reaches sensor $D_{1m}$, corresponding to a reservoir height below which the dirt is for example less resistant to cleaning due in particular to the flow of cleaning fluid over the walls from previous rotations, the microcomputer causes the rotational speed of the motor to change, increasing it for example.

This change in rpm may be effected as the jets of fluid descend in the tank, and at different heights relative to different heightwise positions of the nozzle-carrying carriages.

When the carriage has reached the last sensor on the guide lance denoted $D_{1d}$ and the rotation sensor has alerted the microcomputer that its rotation has ended, then the microcomputer emits signals to the cleaning fluid dispensing unit and to the pneumatic system in order to switch the cleaning fluid and the pneumatic fluid controlling the jacks to the second guide lance which is equipped with nozzles to be activated.

It can also change rpm since the last wall to be cleaned has been presoaked.

Cleaning of this lower wall by fluid jets from the second oblique lance is accomplished identically to the cleaning of the vertical wall. The nozzle-carrying carriage moves from sensor $D_{2l}$ to sensor $D_{2d}$.

When the nozzle-carrying carriage reaches the last sensor on the oblique lance denoted $D_{2d}$ and the rotation sensor detects the end of rotation of the stand, then the microcomputer stops the cleaning fluid pressurization pump and the motor. It then goes on to the next lance when the tool is equipped with several guide lances, in exactly the same way as described in the previous description.

This embodiment optimizes operation of the device by cutting down tank cleaning time.

In the case where the cleaning fluid used is a detergent or a mixture of water and additives, the tank needs to be completely rinsed with water. This operation may be conducted at the end of the cleaning operation, as follows. After reaching the last sensor on the last lance denoted $C_{kd}$, and when the rotation sensor has detected the end of rotation of the stand, the microcomputer cuts off the detergent valve dispensing to the water reserve or commands dispensing of the rinsing fluid such as water from an additional reservoir, not shown, with tank rinsing preferably taking place from bottom to top.

By turning off and restarting the circulation pump, it commands the transition of water dispensing to the nozzles with which the vertical guide lance is equipped. This operation assumes that the reservoir or reservoirs containing the rinsing water are all connected to pipe 12. The microcomputer than causes the nozzle-carrying carriage to rise, which rise can be made faster than the descent in the cleaning operation by increasing the rotational speed of the rotating stand. Upon this rise, the water rinses the vertical walls of the tank, and the bottom wall of the tank or lower wall is rinsed as the water trickles down the vertical walls.

In the various embodiments of the method according to the invention, the cleaning fluid and possibly the rinsing fluid are collected at the bottom of the container before they are drained, which draining can take place either through a pipe located at the bottom of the tank or through a hose equipped with a pumping device for pumping out and evacuating the fluid.

It is also possible to recycle the cleaning fluid by equipping the tank with a device for collecting the cleaning fluid and bringing it back to cleaning fluid reservoir R.

The same may be done for the rinsing water.

These water recycling operations are particularly useful for applications of the tool in arid or desert regions.

It is preferable to fit a filter onto the cleaning fluid incoming pipes to prevent large particles or foreign bodies from clogging the nozzles.

Figure 4:
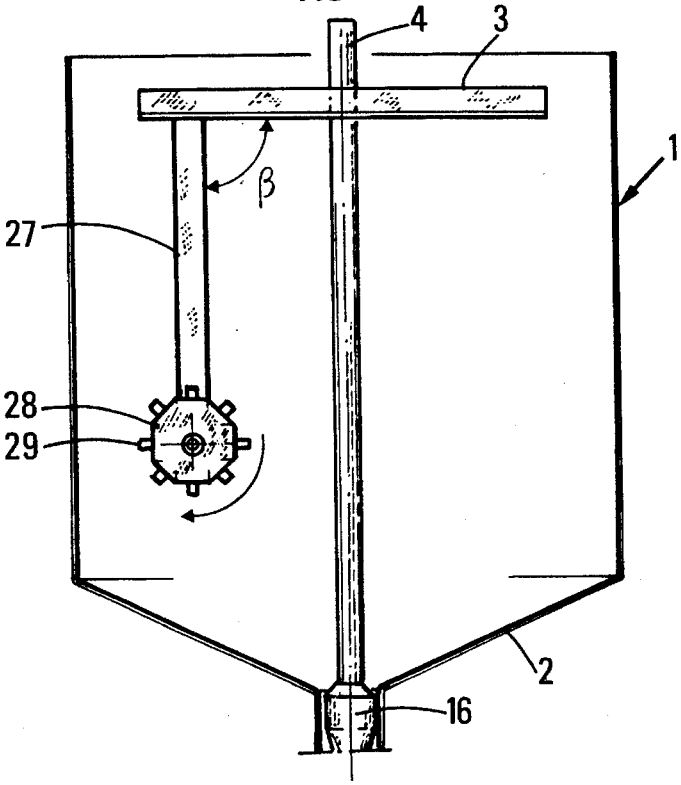

According to another embodiment of the device shown in FIG. 4, the cleaning tool includes rotating stand 3 integral with rotating shaft 4 which can move along this shaft. A means such as a lance 27 is attached to the stand, with the axis of this lance forming an angle β chosen as a function of the geometry of the tank to be cleaned. The lance is fitted with a device 28 allowing jets of cleaning fluid to be delivered in different directions in order to sweep the walls of the tank to be cleaned in their entirety.

Thus it is possible to use a head equipped with several nozzles 29 with different orientations chosen according to the tank geometry, which head 28 is positioned for example at the end of the lance. Head 28 can also move along the lance, with the lance being fixed relative to rotating stand 3.

The lance is positioned at a certain distance from the walls of the tank to be cleaned.

Rotation of the rotating stand combined with spraying of the jets of cleaning fluid in several directions allows the walls of the tank to be cleaned to be swept in their entirety.

Implementation of such a device is similar to the method described in relation to FIGS. 1, 2, 3A, and 3B, except for dispensing of the cleaning fluid which in this case is effected not from one lance to another but from one nozzle 29 to another nozzle in order to produce jets with different orientations.

In the case of tanks of very large size such as oil tanks with horizontal bottoms, it would not be a departure from the invention to motorize rotation of the lances not by a central drive (accomplished in FIG. 2 by motor 13 integral with shaft 4) but by a device carrying at least one lance, the device having motorization means allowing it to move on the bottom of the tank. The motorized device is for example integral with a pin preferably located in the center of the tank to be cleaned by known means such as arms and a lattice system to stabilize the position of the lance. This device rotates around a base in order to allow all the walls of the tank to be cleaned by jets of cleaning fluid.

It would not be a departure from the invention to use any number n of guide lances. In this case, recess 25 would have n upper positions corresponding to the positioning that would bring n different holes into coincidence with n different cleaning fluid circulation pipes.

One may also use all types of position sensors capable of stabilizing the nozzle-carrying carriages in a given position and possibly transmit a signal to an intelligent control element. In this case, these sensors can be protected under adverse application conditions.

It would not be a departure from the invention to use, instead of nozzles j mounted on carriages 7, 8, holes provided in the lances, with the choice and number of these holes being predetermined as a function of their cleaning surface and the geometry of the tank.

In this case, the displacement operations from one sensor to another would be eliminated.

It would not be a departure from the invention to use hydraulic or mechanical jacks associated with appropriate drive means. The piston movement can also be accomplished by pulling on a cable, a chain, or any other suitable mechanical device.

The motor described above is a variable-frequency electric motor coupled to a jack with a gear motor. One could also use a hydraulic or pneumatic motor.

It would not be a departure from the invention to use an initial position sensor and a final position sensor or end-of-travel sensor and means for displacing the nozzle-carrying carriage in order to communicate a helical movement to the whole.

Of course, various modifications and/or additions can be made by the individual skilled in the art to the method and the device described hereinabove in a nonlimiting fashion without departing from the scope of the invention.

We claim:

1. A device for cleaning interior wall surfaces of a tank comprising a reservoir containing cleaning fluid, said reservoir being connected to a means for pressurizing the cleaning fluid, a cleaning tool adapted to be located within said tank, and means for supplying the cleaning fluid from the reservoir to the cleaning tool; the cleaning tool having, in combination, a rotating stand equipped with at least one spraying unit for spraying the cleaning fluid against interior wall surfaces, said spraying unit comprising at least two elongated lances, each of the lances being fitted with at least one nozzle for directing a jet of the cleaning fluid under pressure straight towards at least one of the wall surfaces to be cleaned, one of said two lances defining an angle with the other, the value of which is determined as a function of the geometry of the tank to be cleaned and said nozzles being movable along each of the two lances so that jets of high pressure cleaning fluid sweep across all areas of the interior wall surfaces of the tank, a cleaning fluid dispersing unit for dispersing cleaning fluid selectively to at least one of the nozzles on one of said two lances and means for controlling movement of the nozzles along said lances; said cleaning fluid dispersing unit comprising a cylinder located within said rotating shaft, a piston sliding in the cylinder, means for introducing the cleaning fluid onto one side of the piston and a spring located on an opposite side of the piston, said piston moving under the action of changes in pressure produced by the cleaning fluid in one direction when the pressure drops and in an opposite direction when the pressure increases.

2. A device according to claim 1, further comprising a rotating shaft on which the rotating stand is positioned, one of the two lances being arranged parallel to the rotating shaft and said cleaning tool being positioned within a tank having a cylindrical wall so that the one lance also rotates parallel to said cylindrical wall and the other lance is arranged to extend obliquely to the cylindrical wall.

3. A device according to claim 1, wherein the means for controlling movement of the nozzles comprises a plurality of position sensors fitted along each of said lances, said nozzles being arranged to move from one position sensor to another.

4. A device according to claim 3, wherein said control means includes pneumatic means for moving the nozzles along each of said two lances.

5. A device according to claim 1 further comprising a fluid-pressurization pump, said piston and said spring being moved by stopping and starting of said fluid-pressurization pump.

6. A device according to claim 1, wherein the number of nozzles is determined by the geometry of the tank to be cleaned.

7. A device according to claim 1, wherein said spraying unit is connected to drive means for moving the spraying unit relative to the wall surfaces to be cleaned.

* * * * *